US006604616B2

(12) United States Patent
Cheng

(10) Patent No.: US 6,604,616 B2
(45) Date of Patent: Aug. 12, 2003

(54) CONTAINER WITH MULTI-FUNCTIONAL EDGE FRAME ARRANGEMENT

(76) Inventor: Chun Lung Cheng, 1786 Curtis Ct., La Verne, CA (US) 91750

( * ) Notice: Subject to any disclaimer, the term of this patent is extended or adjusted under 35 U.S.C. 154(b) by 0 days.

(21) Appl. No.: 10/035,284

(22) Filed: Jan. 3, 2002

(65) Prior Publication Data

US 2003/0121740 A1 Jul. 3, 2003

(51) Int. Cl.[7] ..... A45C 5/14; A45C 13/36; B65D 13/00; B65D 21/02

(52) U.S. Cl. ..... 190/24; 190/25; 190/108; 190/122; 190/123; 190/18 A; 220/668; 206/503

(58) Field of Search ..... 190/18 A, 24–26, 190/37, 107, 108, 122, 123; 220/4.28, 4.26, 668; 206/503

(56) References Cited

U.S. PATENT DOCUMENTS

| | | | | | |
|---|---|---|---|---|---|
| 355,946 | A | * | 1/1887 | Oestreicher | 190/37 |
| 542,574 | A | * | 7/1895 | Slama | 190/37 |
| 1,057,913 | A | * | 4/1913 | Andrews | 190/37 |
| 1,084,360 | A | * | 1/1914 | Rahm | 190/108 |
| 1,265,212 | A | * | 5/1918 | Kleber | 190/24 |
| 1,559,942 | A | * | 11/1925 | Dempsey | 190/107 X |
| 1,908,671 | A | * | 5/1933 | Hossfeld | 190/25 |
| 2,478,563 | A | * | 8/1949 | Book | 190/18 A X |
| 2,724,468 | A | * | 11/1955 | Mautner | 190/37 |
| 2,950,792 | A | * | 8/1960 | Axtell | 190/126 X |
| 3,962,010 | A | * | 6/1976 | Riou et al. | 190/122 X |
| 4,422,212 | A | * | 12/1983 | Sheiman et al. | 190/18 A X |
| 4,540,071 | A | * | 9/1985 | Schaub et al. | 190/121 |
| 4,619,363 | A | * | 10/1986 | Wolfseder | 206/503 X |
| 4,743,038 | A | * | 5/1988 | Myers et al. | 190/18 A X |
| 4,770,312 | A | * | 9/1988 | O et al. | 190/107 X |
| 4,813,542 | A | * | 3/1989 | Thompson et al. | 190/37 X |
| 5,044,476 | A | * | 9/1991 | Seynhaeve | 190/123 X |
| 5,634,539 | A | * | 6/1997 | Gordon | 190/24 |
| 5,996,749 | A | * | 12/1999 | Hillsberg et al. | 190/122 X |

FOREIGN PATENT DOCUMENTS

| | | | | |
|---|---|---|---|---|
| BE | 543982 | * | 9/1959 | 190/122 |
| CA | 964237 | * | 3/1975 | 190/122 |
| DE | 2758392 | * | 7/1979 | 190/37 |
| DE | 3900412 | * | 7/1990 | 190/126 |
| DE | 4013178 | * | 10/1991 | 190/24 |
| EP | 359903 | * | 3/1990 | 190/37 |
| FR | 2506137 | * | 11/1982 | 190/108 |
| JP | 55-101526 | * | 2/1980 | 206/503 |

* cited by examiner

*Primary Examiner*—Sue A. Weaver
(74) *Attorney, Agent, or Firm*—Raymond Y. Chan; David & Raymond Patent Goup

(57) ABSTRACT

A container, incorporated with a multi-functional edge frame arrangement, includes a container body including a base panel and a plurality side panels connected to edge portions of said base panel respectively. The multi-functional edge frame arrangement includes a plurality of edge frames, each having a main frame having a L-shaped cross section and two edge holders provided at two side ends of the main frame. An edge portion of the side panel and an edge portion of the base panel are arranged to securely mount along the edge holders respectively so as to connect the side panel with the base panel. At least one of the edge frames is constructed to form a utility edge frame and the multi-functional edge frame arrangement further includes a mounting unit provided on the utility edge frame and a container accessory including a reinforcing member shaped and sized to fittedly mount on the mounting unit.

13 Claims, 7 Drawing Sheets

CONTAINER WITH MULTI-FUNCTIONAL EDGE FRAME ARRANGEMENT

BACKGROUND OF THE PRESENT INVENTION

1. Field of Invention

The present invention relates to containers, and more particularly to a container with a multi-functional edge frame arrangement which is constructed to enable various of container supports, such as wheels, stands, or connectors, to be selectively mounted on the container, so as to facilitate a user to arrange the container(s) more effectively.

2. Description of Related Arts

A typical container is constructed by a plurality of panels which are made of stiff material such as metal or aluminum to provide a rigid box structure for protecting items inside the container. In order to connect the panels together in an edge to edge manner, an edge frame, which has a L-shaped cross section and two longitudinal U-shape side holders extended at two end sides respectively, is commonly used to perpendicularly connect two edge sides of two panels to the two holder sides of the edge frame respectively. For some other conventional metal containers, hinges are used to connect two panels. However the hinge may not rigidly connect the two respective panels together. Besides, the hinge fails to protect the connections of the container.

The problem with these conventional containers is that they are bulky, usually heavy, and difficult to carry. It is preferred for the container to be incorporated with wheels or ground stand for carrying and supporting the container easily in a stable manner. However, in order to rotatably mount the wheel on the container, a wheel assembly must be embedded into the container. In other words, the wheel assembly must require a certain space of a storage cavity of the container so as to reduce a valuable storing space of the container. Thus, the original rigid structure of the container must be altered to incorporate with the wheel assembly.

In addition, if the user is carrying more than one container, such as a luggage container, a notebook computer container and a camera container, all the containers have no connection between each other so that the user have to actually carry all the containers with his or her hands and shoulders.

Moreover, storing the containers is another problem for the user. In order to arrange the containers, the user may usually pile up the containers in columns. However, when the containers are not piled up properly, the containers at the upper deck of the column may fall down, which may cause an unwanted injury to the user. Thus, the items inside the containers may be damaged by the accumulated weight of the containers when they are piled up. Otherwise, the user must build a supporting shelf to store the containers.

SUMMARY OF THE PRESENT INVENTION

A main object of the present invention is to provide a container with multi-functional edge frame arrangement that enables a user to selectively mount a container accessory such as wheels or ground stand on the container without altering the original structural design of the container.

Another object of the present invention is to provide a container with multi-functional edge frame arrangement which enables a user to selectively connect another container thereto so that he or she can merely carry the present invention without actually carrying all the containers independently.

Another object of the present invention is to provide a container with multi-functional edge frame arrangement, which not only substantially connects two panels of the container together but also protects the edge of the container from collision.

Another object of the present invention is to provide a container with multi-functional edge frame arrangement which comprises a connector for rigidly connecting two containers together side by side in such a manner that the user is able to rigidly pile up the containers to from a cubic structure. In other words, the containers can be stored effectively by piling up the containers in a rigid connecting manner.

Another object of the present invention is to provide a container with multi-functional edge frame arrangement, wherein no expensive or complicated structure is required to employ in the present invention in order to achieve the above mentioned objects. Therefore, the present invention successfully provides an economic and efficient solution for providing a reinforced supporting configuration to the container.

Accordingly, in order to accomplish the above objects, the present invention provides a container, which comprises:

- a container body comprising a base panel and a plurality of side panels connected to sides of the base panel respectively; and
- a multi-functional edge frame arrangement, comprising:
  - a plurality of edge frames, each having a L-shaped cross section and comprising two elongated edge holders which are longitudinally extended along two longitudinal end edges of the respective edge frame respectively and arranged to securely mount along an edge portion of the side panel and an edge portion of the base panel respectively so as to connect the side panel with the base panel;
  - at least an elongated mounting unit provided on at least one of the edge frames constructing the edge frame to form a utility edge frame wherein the mounting unit is longitudinally extended between the two edge holders and along the utility edge frame; and
  - a container accessory comprising a reinforcing member shaped and sized to fittedly mount on the mounting unit.

DETAILED DESCRIPTION OF THE PREFERRED EMBODIMENT

Figure 1:
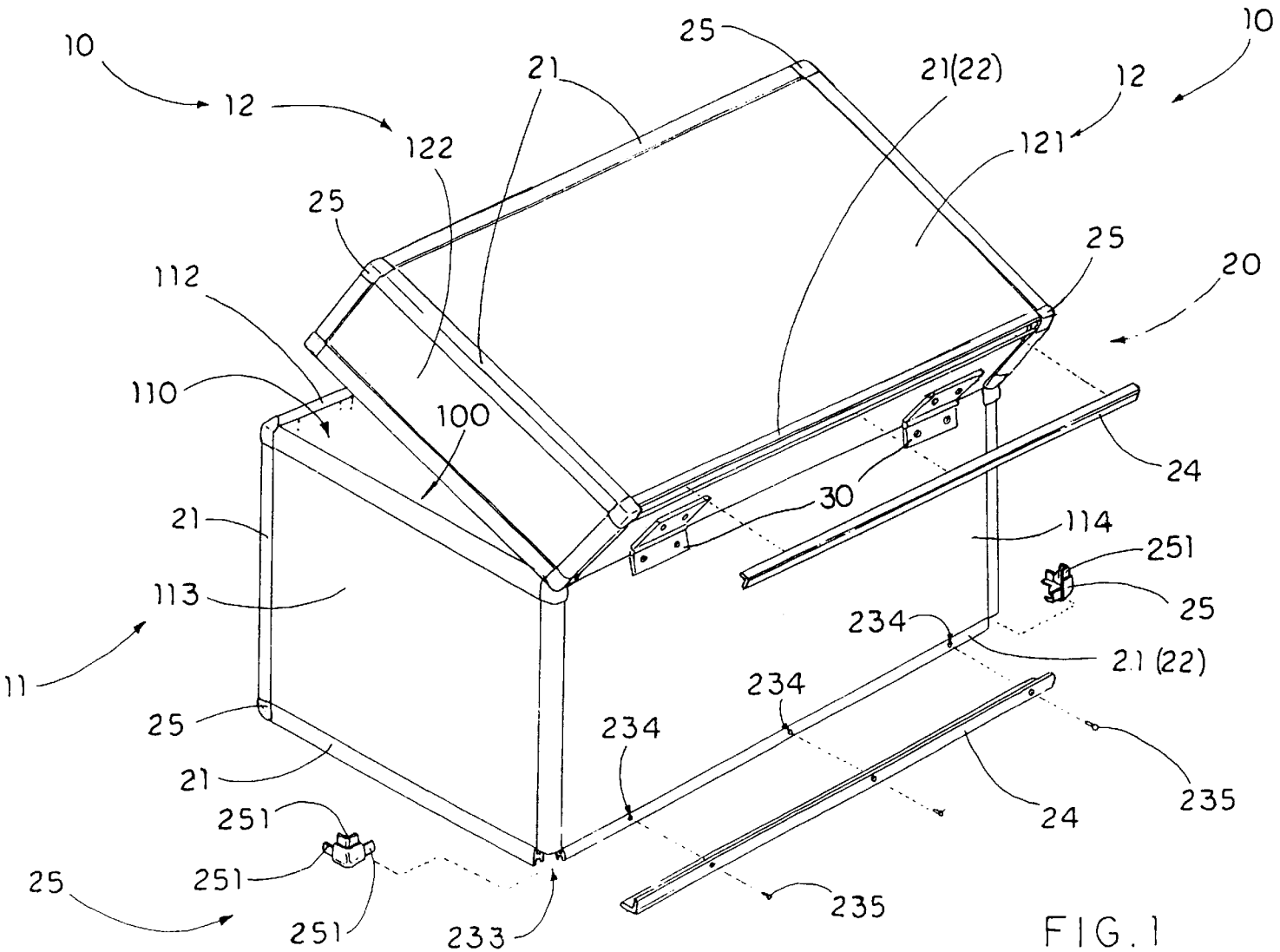
FIG. 1 is a perspective view of a container incorporated with a multi-functional edge frame arrangement according to a first preferred embodiment of the present invention.
Figure 2:
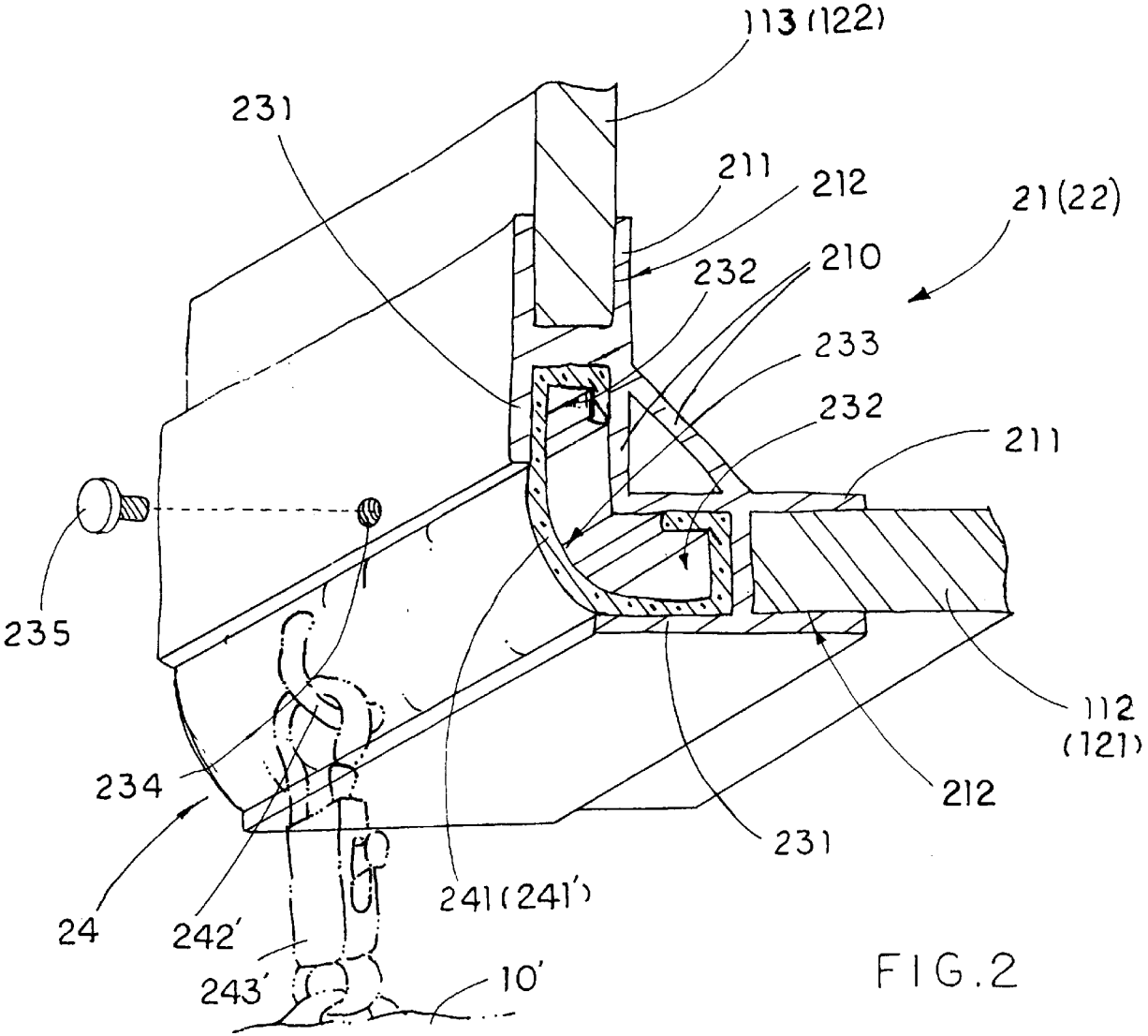
FIG. 2 is a sectional view of the multi-functional edge frame arrangement for the container according to the above first preferred embodiment of the present invention.

Referring to FIGS. 1 and 2 of the drawings, a container 10 incorporated with a multi-functional edge frame arrangement 20 according to a first preferred embodiment of the present invention is illustrated, wherein the container 10 comprises a container body 11 comprising a base panel 111 and two pairs of side panels 112, 113 to define a storage compartment 110 therebetween.

The multi-functional edge frame arrangement 20 comprises eight edge frames 21 for perpendicularly connecting the four side panels 112, 113 with the base panel 111 in an edge to edge manner to form a rectangular box structure. Each of the edge frames 21 comprises a main frame 210 having L-shaped cross section and two edge holders 211 longitudinally extended along two longitudinal end edges of the main frame 210 to securely connect with two edge portions of the side panels 111 or base panel 112 respectively so as to connect the side panels 111 and the base panel 112 together.

At least one of the edge frames 21 is constructed to form a utility edge frame 22 which further comprises a mounting unit 23 provided thereon, wherein the mounting unit is longitudinally extended between the two edge holders 211 and along the utility edge frame 22. The multi-functional edge frame arrangement 20 further comprises a container accessory 24 which comprises a reinforcing member 241 shaped and sized to fittedly mount on the mounting unit 23.

Figure 3A:
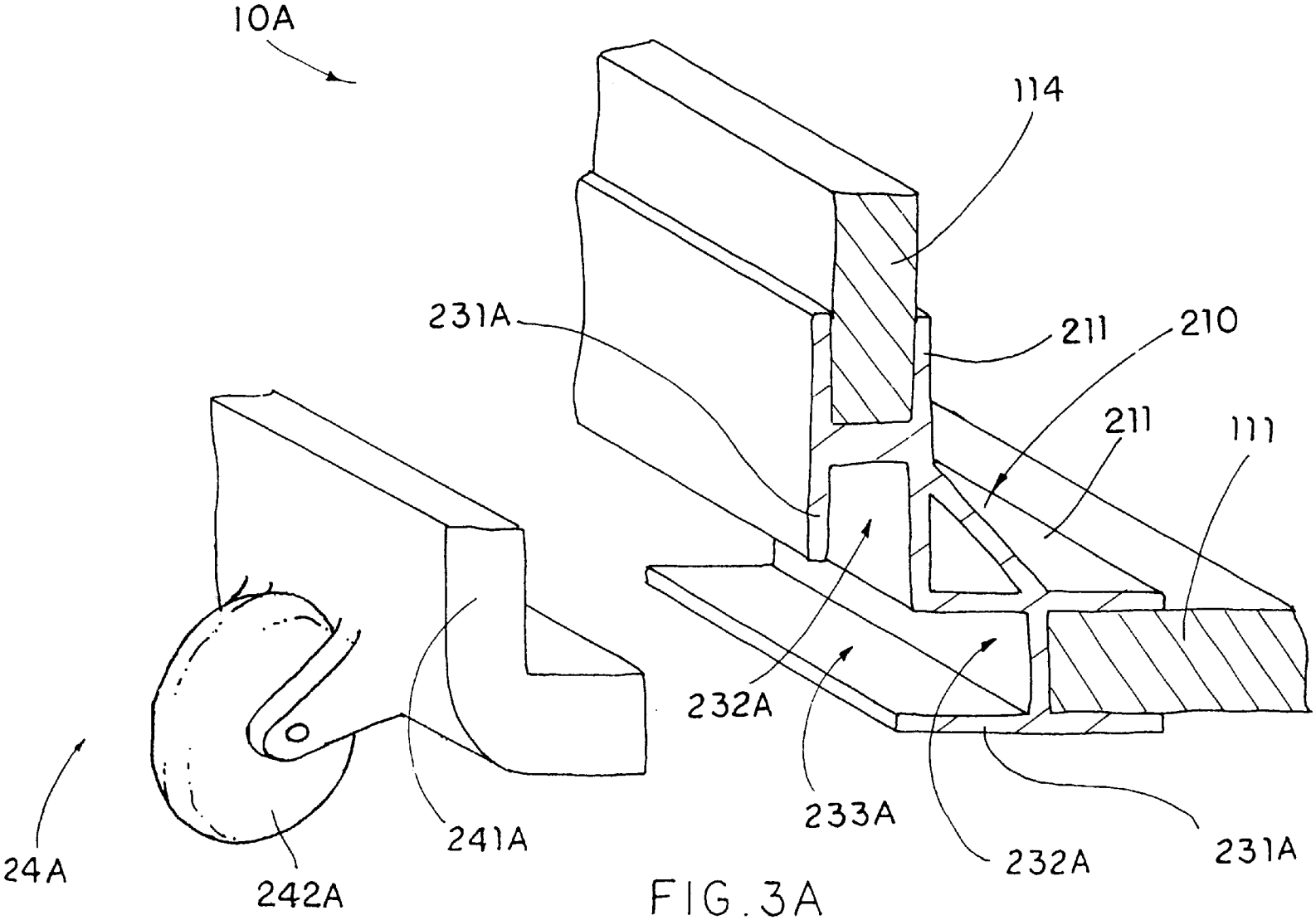
FIGS. 3A to 3B illustrate alternative modes of a utility appliance of the multi-functional edge frame arrangement for the container according to the above first preferred embodiment of the present invention.

According to the preferred embodiment, the edge holders 211, each having a U-shaped cross section structure to define a mounting slot 212 therealong, securely mount the edge portions of the base panels 111 and the side panel 112 along the mounting slots 212 respectively, so as to connect two of the side panels 112 (as shown in FIG. 2) or the base panel 111 with the side panel 112 (as shown in FIG. 3A) edge to edge together.

Each of the side panels 113 of the container body 11 has three edge portions connected to the edge portion of the base panel 111 and two edge portions of the two adjacent side panels 112 by three of the edge frames 21 respectively so that the container body 11 is constructed to form the box structure and defined a top opening 100 therefor.

The container 10 further comprises a container cover 12 connected to the container body 11 by hinges 30 at one side. The container cover 12 comprises a top panel 121 having four edge portions and four cover panels 122 each having at least an edge portion wherein the top panel 121 is connected to the cover panels 122 by mounting the edge portions of the top panel 121 and the four cover panels 122 to the edge holders 211 of four of the edge frames 21 respectively. Accordingly, at least one of the edge frames 21 is formed as the utility edge frame 22 to connect the top panel 121 with one of the cover panels 122.

In other words, a plurality of the edge frames 21 are used connect all the panels (the base panel 111, the side panels 112, the front panel 112, the rear panel 114, the top panel 121, and the cover panels 122) together by mounting the edge portion thereof along the mounting slot 212 of the edge holders 211 of the edge frames 21, so as to form the container body 11 and the container cover 12, as shown in FIG. 1. In which, it is worth to mention that all of the edge frames 21 can be constructed as the utility edge frames 22.

The multi-functional edge frame arrangement 20 further comprises a plurality of corner frames 25 arranged to securely mount between ends of the edge frames 21 and/or utility edge frames 22, i.e. at eight corners of the container body 11 and eight corners of the container cover 12 respectively. It is worth to mention that each of the corner frames 25 comprises at least an inserting arm 251 extended outwardly and arranged to slot in an end portion of the slider groove 232 so as to mount the corner frame 25 at the corner of the container body 11.

As shown in FIG. 2, according to the preferred embodiment of the present invention, the mounting unit 23 of the utility edge frame 22, which is extended between the two edge holders 211 and along the utility edge frame 22, comprises a pair of mounting rails 231 integrally extended from the utility edge frame 22 to define an elongated slider groove 232 formed between each mounting rail 231 and the main frame 210 of the utility edge frame 22 so as to integrally and longitudinally define a L-shaped holding channel 233 with the two slider grooves 232.

The reinforcing member 241 of the container accessory 24, according to the preferred embodiment, can be an edge protector 241' made of rubber to provide additional cushioned protection for the container 10. As shown in FIGS. 1 and 2, each of the edge protector 241' is slidably mounted along the respective holding channel 233 by receiving two longitudinal edges of the reinforcing member 241 in the two slider grooves 232. In other words, the edge protector 241' of the reinforcing member 241 is mounted along the respective edge of the container body 11, so as to prevent the container body 11 from collision at the edge thereof. Moreover, the edge protectors 241' can be made of different color to decorate the container 10.

As illustrated by the phantom lines in FIG. 2, the reinforcing member 241 can be made of metal and provided with at least a ring-shaped connecting element 242' integrally projected thereon so that another container 10' can be connected with the container 10 by detachably hooking a connector 243' to the connecting ring 242'.

In order to securely hold the reinforcing member 241 along holding channel 233, mounting unit 23 further has at least two screw holes 234 spaced provided on each of the mounting rails 231 and at least two positioning screws 235 arranged to rotatably penetrated through the reinforcing member 241 through the screw holes 234 respectively, so as to securely hold the longitudinal edges of the reinforcing member 241 within the slider grooves 232 respectively, as shown in FIG. 2.

FIG. 3A illustrates a first alternative mode of the container accessory 24A wherein the reinforcing member 241A, which is made of durable material such as metal, is shaped and sized to slidably fit into the holding channel 233A by receiving two longitudinal edges of the reinforcing member 241A in the two slider grooves 232A of the mounting rails 231A. The container accessory 24A further comprises at least a container wheel 242A rotatably mounted on the reinforcing member 241A. Therefore, the user is able to carry the container 10A with the container wheels 242A easily.

Figure 3B:
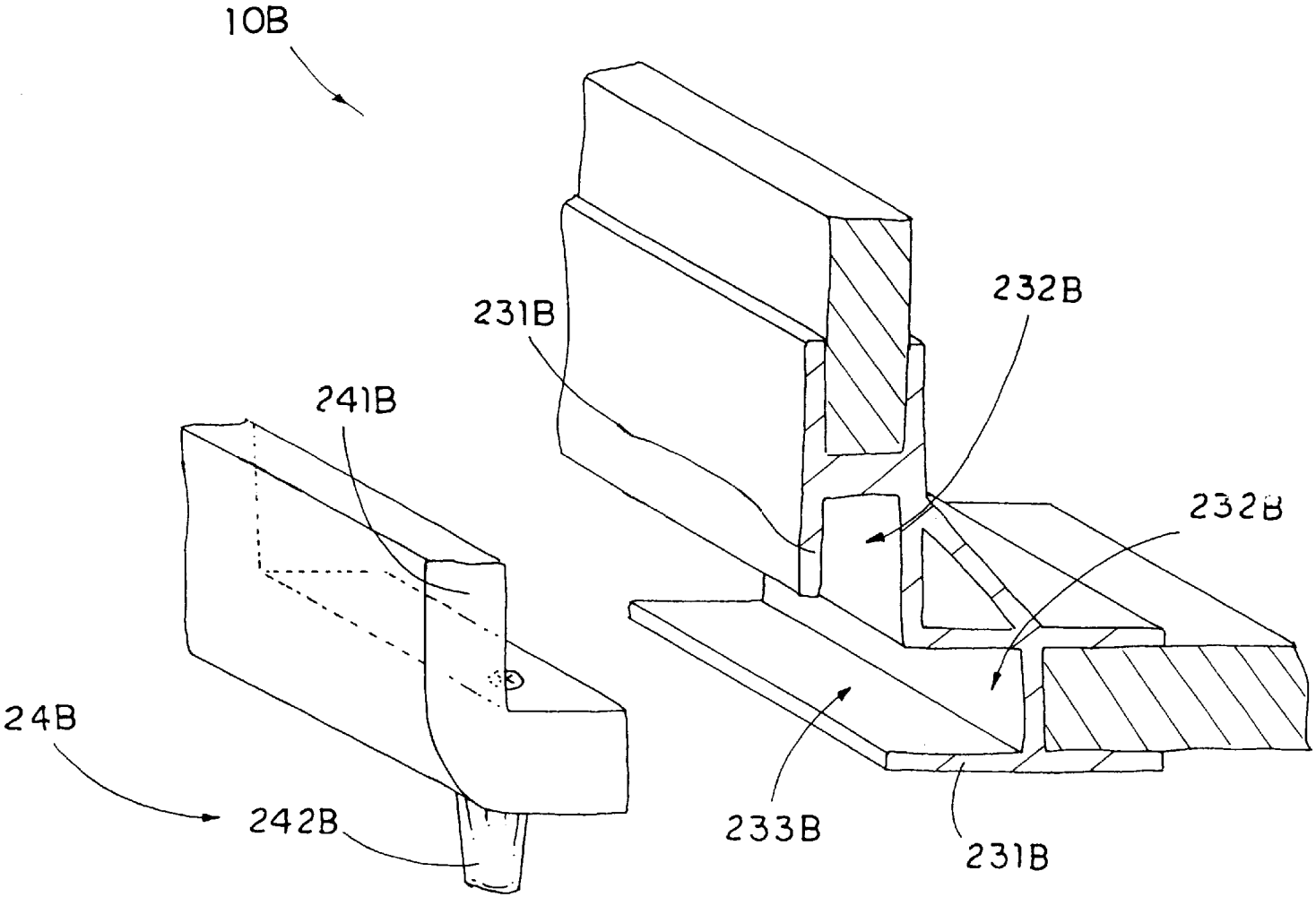

FIG. 3B illustrates a second alternative mode of the container accessory 24B wherein the reinforcing member 241B, which is made of durable material such as metal, is shaped and sized to slidably fit into the holding channel 233B by receiving two longitudinal edges of the reinforcing member 241B in the two slider grooves 232B of the two mounting rails 231B. The container accessory 24B further comprises at least a ground stand 242B downwardly extended from the reinforcing member 241B, so as to substantially support the container 10B on the floor.

Figure 4:
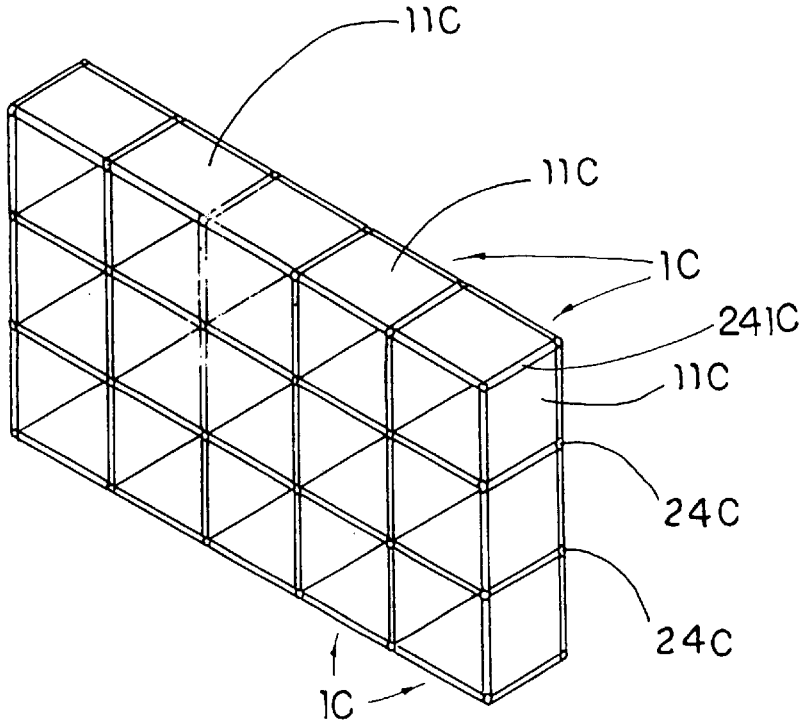
FIG. 4 illustrates an application of the multi-functional edge frame arrangement for the container according to the above first preferred embodiment of the present invention.

FIG. 4 illustrates an alternative mode of the container accessory 24C which is adapted to mount two containers 1C together. The reinforcing member 241C, having a U-shaped, also has two elongated edge lockers formed along the two longitudinal edges of the reinforcing member 241C, wherein one of the edge lockers is fittedly slid into the one of the slider grooves while another edge locker is fittedly slid into one of the respective slider grooves of another container body 11C, such that the two container bodies 11C are securely connected together. In other words, the container bodies 11C are adapted to be connected together to form a shelf that each container body 11C is formed as a cell of the shelf, as shown in FIG. 4.

Figure 5:
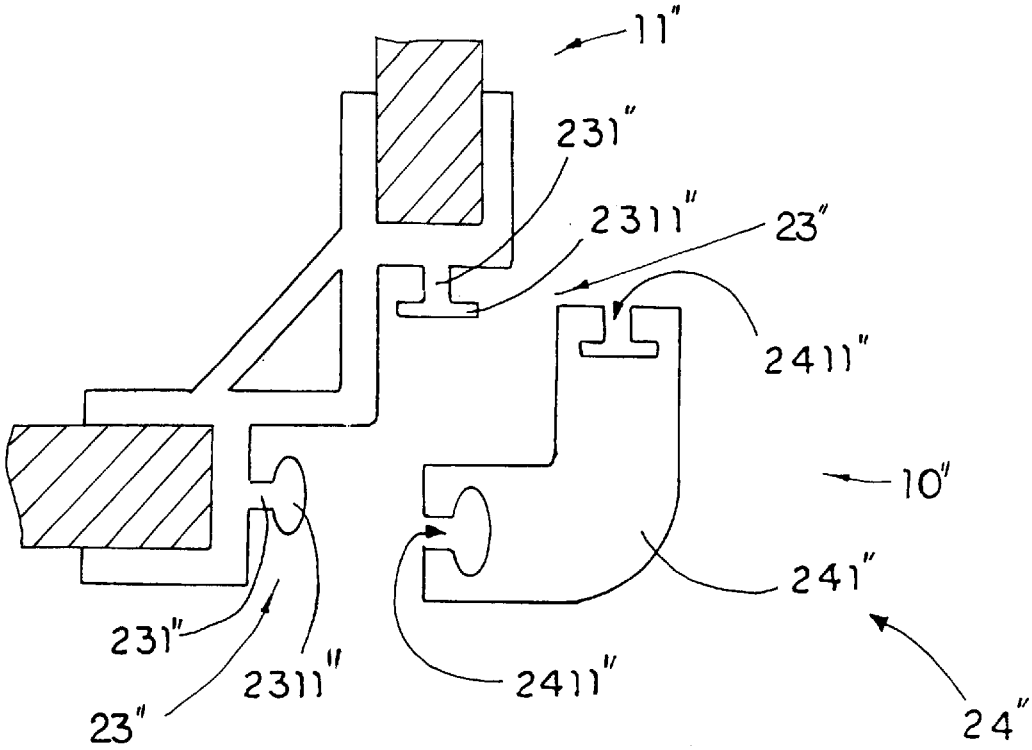
FIG. 5 is a sectional view of a multi-functional edge frame arrangement for the container according to a second preferred embodiment of the present invention.

Referring to FIG. 5 of the drawings, a second preferred embodiment illustrates an alternative mode of the container 10". The difference of the second preferred embodiment is that the mounting unit 23" comprises at least a mounting rail 231" integrally extended from the utility edge frame 22" wherein the mounting rail 231" has an enlarged head portion 2311" to form a particular shape such as T-shape, so as to securely hold the reinforcing member 241" of the container accessory 24" in position. The reinforcing member 241", which can be an edge protector made of rubber or metal, has at least a corresponding slider track 2411" adapted to slidably mount along the mounting rail 231" such that the reinforcing member 241" is mounted along the respective edge of the container body 11".

As shown in FIG. 5, there are two mounting rails 231" integrally extended from the utility edge frame 22" wherein each of the mounting rails 231" has the head portion 2311" with different shape. Two longitudinal edges of the reinforcing member 241" are formed as the two slider tracks 2411" having corresponding shapes and arranged to slidably mount along the mounting rails 231" respectively, so as to securely mount the container accessory 24" on the mounting unit 23".

Figure 6A:
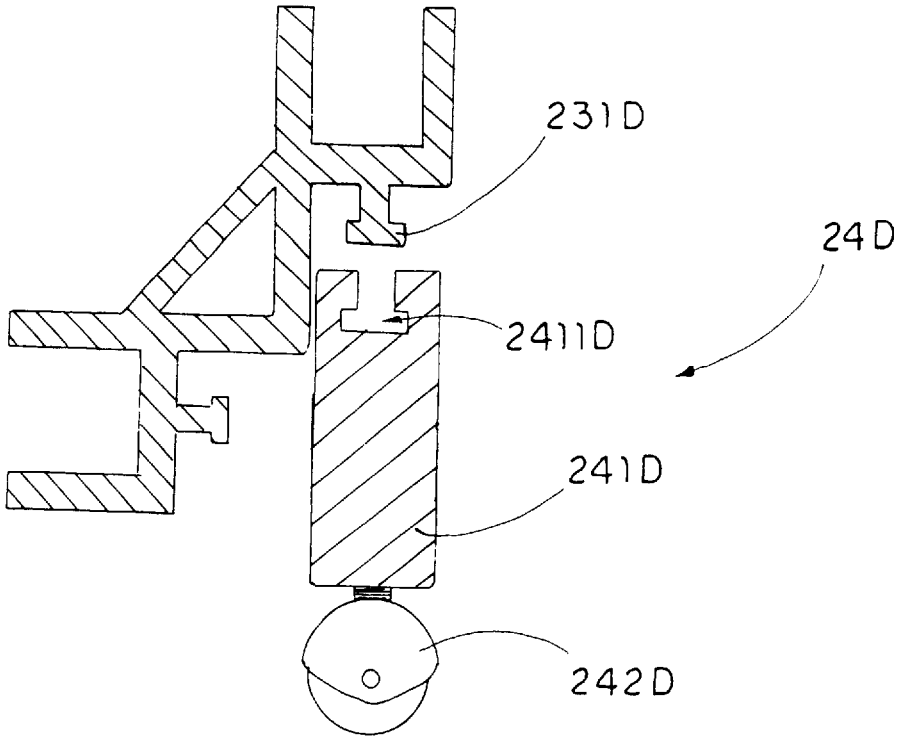
FIGS. 6A to 6C illustrate alternative modes of a utility appliance of the multi-functional edge frame arrangement for the container according to the above second preferred embodiment of the present invention.
Figure 6B:
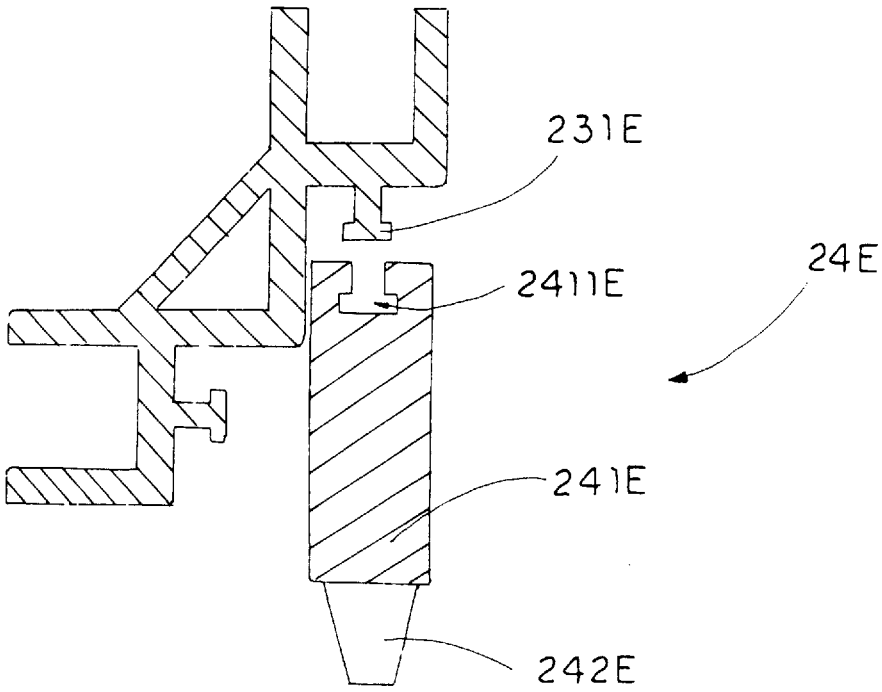
Figure 6C:
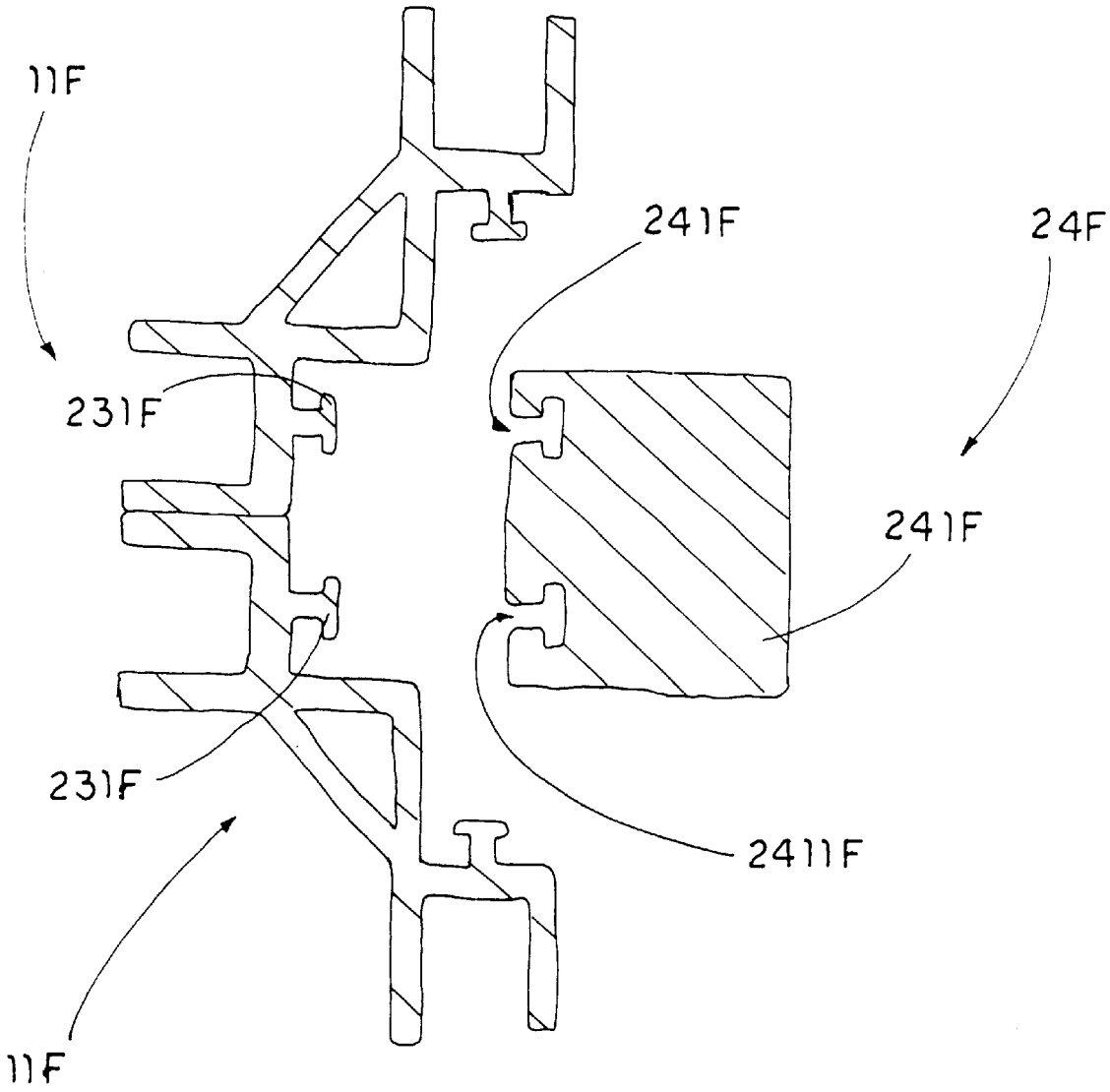

FIGS. 6A through 6C illustrates the alternative modes of the container accessory 24D, 24E wherein the reinforcing member 241D, 241E, which is made of durable material such as metal, has the slider track 2411D, 2411E shaped and sized to slidably fit to the mounting rail 231D, 231E. The container accessory 24D further comprises at least a container wheel 242D rotatably mounted on the reinforcing member 241D so as to enhance the portability of the container, as shown in FIG. 6A. Alternatively, the container accessory 24E further comprises at least a ground wheel 242E downwardly extended from the reinforcing member 241E so as to substantially support the container, as shown in FIG. 6B.

Moreover, the reinforcing member 241F, having a U-shaped, has two slider tracks 2411F formed on the reinforcing member 241F, wherein one of the slider tracks 2411F is fittedly slid into the one of the mounting rail 231F while another slider tracks 2411F is fittedly slid into one of the respective mounting rail 231F of another container body 11F, so as to securely connect two container bodies 11F together, as shown in FIG. 6C.

What is claimed is:

1. A container, comprising:

a container body comprising a base panel having a plurality of edge portions and a plurality of side panels connected to said edge portions of said base panel respectively; and a multi-functional edge frame arrangement, comprising:

a plurality of edge frames, each comprising a main frame having a L-shaped cross section and two elongated edge holders which are longitudinally extended along two longitudinal end edges of said main frame respectively, wherein said edge frames are arranged to securely mount said edge portions of base panel with adjacent edge portions of said side panels so as to connect said side panels with said base panel to form a box structure;

at least an elongated mounting unit provided on at least one of said edge frames constructing said edge frame to form a utility edge frame, wherein said mounting unit is longitudinally extended between said two edge holders and comprises a pair of mounting rails integrally extended from said utility edge frame, wherein an elongated slider groove is formed between each mounting rail and said utility edge frame so as to define a L-shaped holding channel between said two slider grooves; and a container accessory comprising a reinforcing member shaped and sized to fittedly mount on said mounting unit, wherein said reinforcing member slidably mounted along said holding channel by receiving two longitudinal edges of said reinforcing member in said two slider grooves.

2. The container, as recited in claim 1, wherein said container accessory further comprises at least a container wheel rotatably mounted on said reinforcing member.

3. The container, as recited in claim 1, wherein said reinforcing member is an edge protector made of resilient material to provide additional cushioned protection from collision at edges of said container.

4. The container, as recited in claim 1, wherein said reinforcing member has at least a connecting element thereon adapted for detachable connecting with another container by detachably connecting a connector to said connecting element.

5. A container, comprising:

a container body comprising a base panel having a plurality of edge portions and a plurality of side panels connected to said edge portions of said base panel respectively; and a multi-functional edge frame arrangement, comprising:

a plurality of edge frames, each comprising a main frame having a L-shaped cross section and two elongated edge holders which are longitudinally extended along two longitudinal end edges of said main frame respectively, wherein said edge frames are arranged to securely mount said edge portions of base panel with adjacent edge portions of said side panels so as to connect said side panels with said base panel to form a box structure;

at least an elongated mounting unit provided on at least one of said edge frames constructing said edge frame to form a utility edge frame, wherein said mounting unit is longitudinally extended between said two edge holders; and a container accessory comprising a reinforcing member shaped and sized to fittedly mount on said mounting unit, wherein said reinforcing member has at least a connecting element thereon adapted for detachable connecting with another container by detachably connecting a connector to said connecting element.

6. A container, comprising:

a container body comprising a base panel having a plurality of edge portions and a plurality of side panels connected to said edge portions of said base panel respectively; and a multi-functional edge frame arrangement, comprising:

a plurality of edge frames, each comprising a main frame having a L-shaped cross section and two elongated edge holders which are longitudinally extended along two longitudinal end edges of said main frame respectively, wherein said edge frames are arranged to securely mount said edge portions of base panel with adjacent edge portions of said side panels so as to connect said side panels with said base panel to form a box structure;

at least an elongated mounting unit provided on at least one of said edge frames constructing said edge frame to form a utility edge frame, wherein said mounting unit is longitudinally extended between said two edge holders and comprises a pair of mounting rails integrally extended from said utility edge frame, wherein an elongated slider groove is formed between each mounting rail and said utility edge frame so as to define a L-shaped holding channel between said two slider grooves; and a container accessory comprising a reinforcing member shaped and sized to fittedly mount on said mounting unit, wherein said reinforcing member slidably mounted along said holding channel by receiving two longitudinal edges of said reinforcing member in said two slider grooves;

wherein said base panel has four said edge portions to perpendicularly connect with four said side panels by means of four said edge frames and said four side panels are perpendicularly connected with each other by another four said edge frames in side by side manner so as to form said container body, wherein said multi-functional edge frame further comprises a plurality of corner frames arranged to securely connect between ends of said edge frames so as to form eight corners of said container body;

wherein said container further comprises a container cover connected at a top side of said container body for covering a top opening defined on said container body, wherein said container cover comprises a top panel having a plurality of edge portions and a plurality of cover panels connected to said edge portions of said top panel respectively, wherein said multi-functional edge frame arrangement further comprises additional number of edge frames each of which also comprises a main frame having a L-shaped cross section and two elongated edge holders which are longitudinally extended along two longitudinal end edges of said main frame respectively, wherein said edge frames are arranged to securely mount said edge portions of said top panel with adjacent edge portions of said cover panels so as to connect said cover panels with said base panel to form said container cover;

wherein an elongated mounting unit is provided on at least one of said edge frames of said container cover constructing said edge frame to form a utility edge frame, wherein said mounting unit is also longitudinally extended between said two edge holders for mounting another container accessory thereto which also comprises a reinforcing member shaped and sized to fittedly mount on said mounting unit of said utility edge frame of said container cover.

7. The container, as recited in claim 6, wherein said container accessory further comprises at least a container wheel rotatably mounted on said reinforcing member.

8. The container, as recited in claim 6, wherein said reinforcing member is an edge protector made of resilient material to provide additional cushioned protection from collision at edges of said container.

9. The container, as recited in claim 6, wherein said reinforcing member has at least a connecting element thereon adapted for detachable connecting with another container by detachably connecting a connector to said connecting element.

10. A container, comprising:

a container body comprising a base panel having a plurality of edge portions and a plurality of side panels connected to said edge portions of said base panel respectively; and a multi-functional edge frame arrangement, comprising:

a plurality of edge frames, each comprising a main frame having a L-shaped cross section and two elongated edge holders which are longitudinally extended along two longitudinal end edges of said main frame respectively, wherein said edge frames are arranged to securely mount said edge portions of base panel with adjacent edge portions of said side panels so as to connect said side panels with said base panel to form a box structure;

at least an elongated mounting unit provided on at least one of said edge frames constructing said edge frame to form a utility edge frame, wherein said mounting unit is longitudinally extended between said two edge holders and comprises a pair of mounting rails integrally extended from said utility edge frame, wherein an elongated slider groove is formed between each mounting rail and said utility edge frame so as to define a L-shaped holding channel between said two slider grooves; and a container accessory comprising a reinforcing member shaped and sized to fittedly mount on said mounting unit, wherein said reinforcing member slidably mounted along said holding channel by receiving two longitudinal edges of said reinforcing member in said two slider grooves;

wherein said base panel has four said edge portions to perpendicularly connect with four said side panels by means of four said edge frames and said four side panels are perpendicularly connected with each other by another four said edge frames in side by side manner so as to form said container body, wherein said multi-functional edge frame further comprises a plurality of corner frames arranged to securely connect between ends of said edge frames so as to form eight corners of said container body;

wherein said container further comprises a container cover connected at a top side of said container body for covering a top opening defined on said container body, wherein said container cover comprises a top panel having four edge portions and four cover panels connected to said four edge portions of said top panel respectively, wherein said multi-functional edge frame arrangement further comprises four additional edge frames each of which also comprises a main frame having a L-shaped cross section and two elongated edge holders which are longitudinally extended along two longitudinal end edges of said main frame respectively, wherein said four edge frames are arranged to securely mount said four edge portions of said top panel with said four adjacent edge portions of said four cover panels so as to connect said four cover panels with said base panel to form a rectangular cover body;

wherein an elongated mounting unit is provided on at least one of said edge frames of said container cover constructing said edge frame to form a utility edge frame, wherein said mounting unit is also longitudinally extended between said two edge holders for mounting another container accessory thereto which also comprises a reinforcing member shaped and sized to fittedly mount on said mounting unit of said utility edge frame of said container cover.

11. The container, as recited in claim 10, wherein said container accessory further comprises at least a container wheel rotatably mounted on said reinforcing member.

12. The container, as recited in claim 10, wherein forcing member is an edge protector made of resilient material to provide additional cushioned protection from collision at edges of said container.

13. The container, as recited in claim 10, wherein said reinforcing member has at least a connecting element thereon adapted for detachable connecting with another container by detachably connecting a connector to said connecting element.

* * * * *